US011845109B1

(12) United States Patent
Buchanan

(10) Patent No.: US 11,845,109 B1
(45) Date of Patent: Dec. 19, 2023

(54) ROLLER ASSEMBLY FOR A SCREENING DEVICE

(71) Applicant: Aggregates Equipment, Inc., Leola, PA (US)

(72) Inventor: Steve Buchanan, Willow Street, PA (US)

(73) Assignee: Aggregates Equipment, Inc., Leola, PA (US)

( * ) Notice: Subject to any disclaimer, the term of this patent is extended or adjusted under 35 U.S.C. 154(b) by 0 days.

(21) Appl. No.: 17/826,628

(22) Filed: May 27, 2022

(51) Int. Cl.
*B07B 1/14* (2006.01)
*B07B 1/46* (2006.01)

(52) U.S. Cl.
CPC ..... *B07B 1/145* (2013.01); *B07B 1/46* (2013.01)

(58) Field of Classification Search
CPC ..... B07B 1/46; B07B 1/4636; B07B 1/14; B07B 1/145; B07B 1/15; B07B 1/155; B07B 1/06
USPC ..... 209/606
See application file for complete search history.

(56) References Cited

U.S. PATENT DOCUMENTS

| | | | | |
|---|---|---|---|---|
| 1,519,945 | A | 12/1924 | Weingartner | |
| 3,659,909 | A | 5/1972 | Egbert | |
| 5,152,402 | A | 10/1992 | Matula | |
| 5,163,564 | A | 11/1992 | Matula | |
| 6,978,957 | B2 | 12/2005 | Sugawara | |
| 8,627,962 | B2 | 1/2014 | Cappozzo | |
| 8,646,615 | B2 | 2/2014 | Bruggencate et al. | |
| 2016/0227703 | A1* | 8/2016 | Dettmer | B07B 1/15 |
| 2021/0154704 | A1 | 5/2021 | Tazzoli | |
| 2022/0226863 | A1* | 7/2022 | Esbelani | B07B 1/4609 |

FOREIGN PATENT DOCUMENTS

WO 2020228924 A1 11/2020

* cited by examiner

*Primary Examiner* — Michael McCullough
*Assistant Examiner* — Jessica L Burkman
(74) *Attorney, Agent, or Firm* — Barley Snyder

(57) ABSTRACT

A roller assembly for a screening device includes a shaft extending along a width direction, a pair of discs disposed on the shaft, and a spacing assembly disposed on the shaft between the pair of discs. The spacing assembly includes an inner spacer disposed around the shaft and an outer spacer disposed around the inner spacer. The outer spacer has a body defining an inner receiving space and a support element disposed in the inner receiving space. The body abuts against the discs and is formed of an elastically compressible material. The support element limits compression of the body along the width direction.

20 Claims, 8 Drawing Sheets

ROLLER ASSEMBLY FOR A SCREENING DEVICE

FIELD OF THE INVENTION

The present invention relates to a screening device and, more particularly, to a roller assembly for a screening device.

BACKGROUND

A screening device commonly has a frame and a screen attached to the frame. A plurality of discs of the screening device that are held within the frame rotate and convey a material to be sorted. The spacing of the shafts and discs provides holes of a predetermined size. When a material is placed on the screening device and the screening device is driven, a material is sorted by either moving along a length of the screening device or by falling through the holes in the screening device.

During usage, the material falling through can become stuck between gaps and increase wear, particularly of the discs. The discs are disposed on a rotating shaft and, as the discs wear during rotation, they may move out of position along a length of the shaft, eliminating a necessary spacing between the discs and wearing against an adjacent disc. The discs can also wear at the engagement with the shaft and at an exterior surface contacting and conveying the material, which both further decrease a useful life of the screening device.

SUMMARY

A roller assembly for a screening device includes a shaft extending along a width direction, a pair of discs disposed on the shaft, and a spacing assembly disposed on the shaft between the pair of discs. The spacing assembly includes an inner spacer disposed around the shaft and an outer spacer disposed around the inner spacer. The outer spacer has a body defining an inner receiving space and a support element disposed in the inner receiving space. The body abuts against the discs and is formed of an elastically compressible material. The support element limits compression of the body along the width direction.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
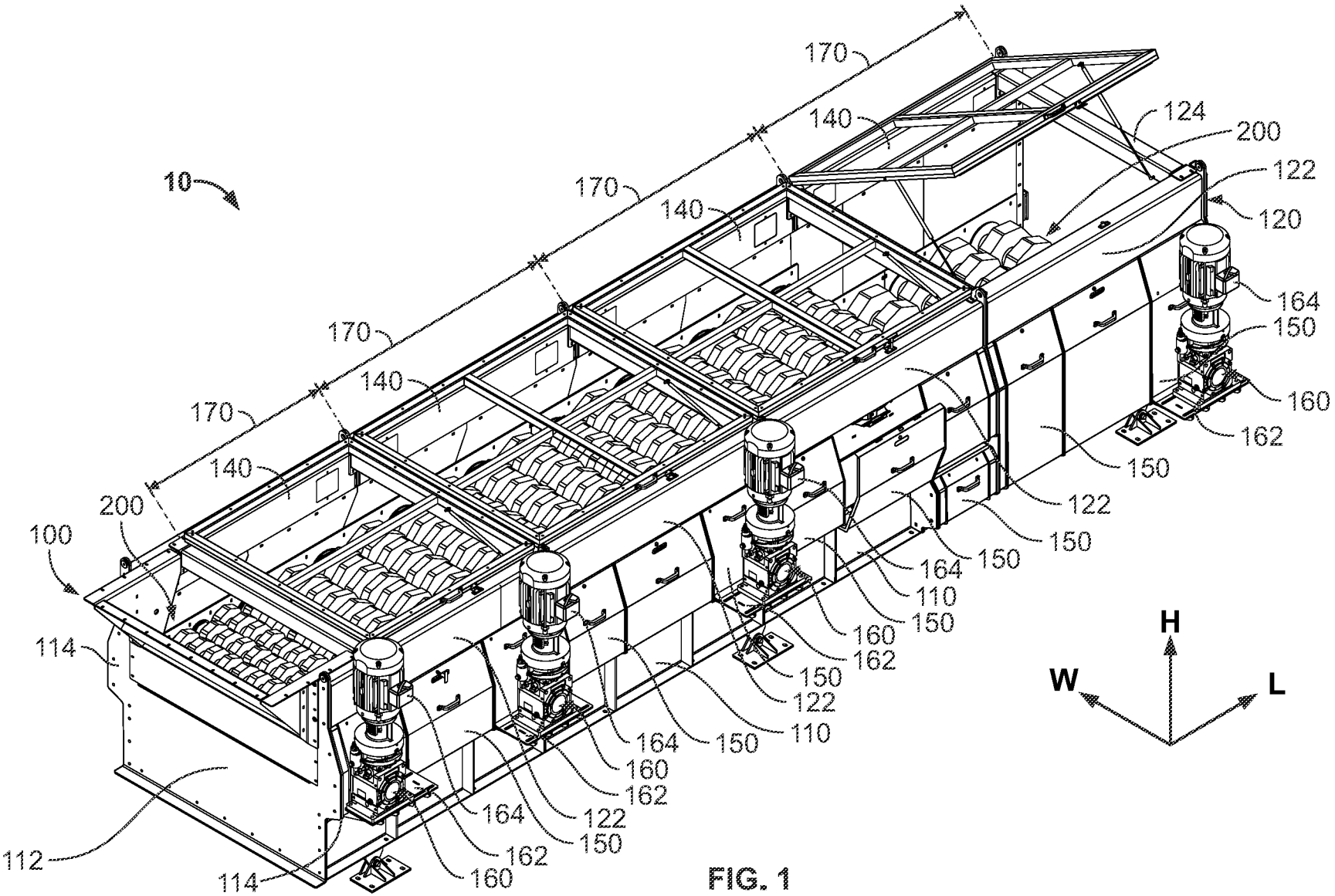
FIG. 1 is a perspective view of a screening device according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth in order to provide a thorough understanding of the disclosed embodiments. However, it is apparent that one or more embodiments may also be implemented without these specific details.

Throughout the specification, directional descriptors are used such as "width", "height", and "longitudinal". These descriptors are merely for clarity of the description and for differentiation of the various directions. These directional descriptors do not imply or require any particular orientation of the disclosed elements.

Throughout the drawings, only one of a plurality of identical elements may be labeled in a figure for clarity of the drawings, but the detailed description of the element herein applies equally to each of the identically appearing elements in the figure.

A screening device 10 according to an embodiment is shown in FIG. 1. The screening device 10 includes a frame 100 and a plurality of roller assemblies 200 attached to and disposed within the frame 100.

Figure 2:
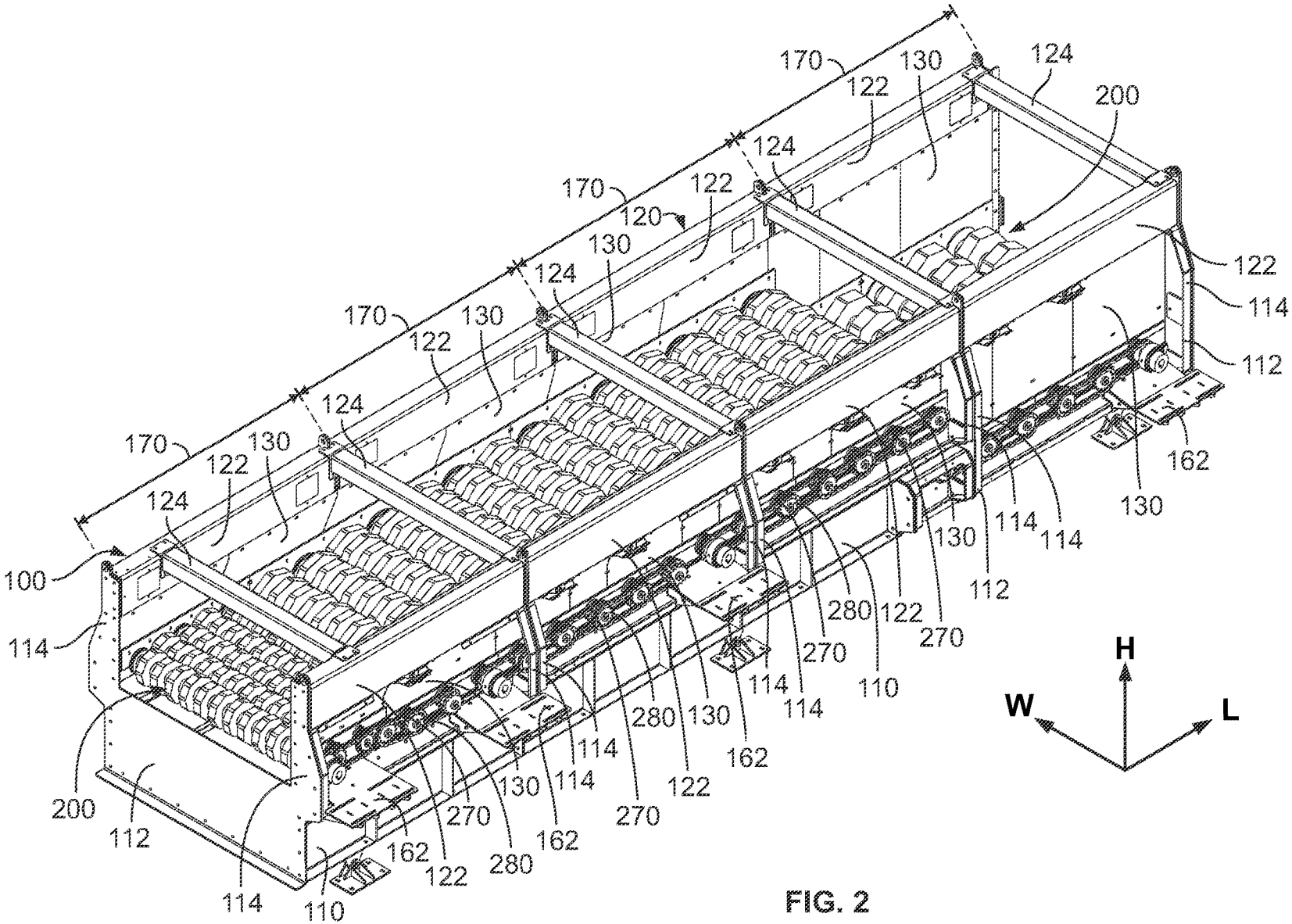
FIG. 2 is a perspective view of a frame and a plurality of roller assemblies of the screening device.

The frame 100, as shown in FIGS. 1 and 2, has a base 110, an upper support structure 120 opposite the base 110 in a height direction H, and a plurality of sidewalls 130 disposed between the upper support structure 120 and the base 110 in the height direction H. The base 110, the upper support structure 120, and the sidewalls 130 are formed of a rigid, durable material, such as a metal.

The base 110 extends along opposite sides of the frame 100 along a longitudinal direction L of the screening device 10 and has end sections 112 distributed along the longitudinal direction L. The end sections 112 extend along a width direction W perpendicular to the longitudinal direction L and each have a pair of arms 114 extending in the height direction H.

The upper support structure 120 is connected between the arms 114 of the end sections 112 of the base 110, as shown in FIG. 2. The upper support structure 120 includes a plurality of longitudinal beams 122 extending along the longitudinal direction L between the arms 114 and a plurality of crossbeams 124 extending perpendicular to the longitudinal beams 122 in the width direction W. The crossbeams 124 extend between the longitudinal beams 122 or between the arms 114 in the width direction W. Each of the longitudinal beams 122 and each of the crossbeams 124 is a tube having a polygonal cross-section to increase a strength of the beam 122, 124. In the shown embodiment, the longitudinal beams 122 each have a rectangular cross-section and the crossbeams 124 each have a square cross-section.

As shown in FIG. 2, the sidewalls 130 are held and secured between the base 110 and the upper support structure 120. The sidewalls 130 extend between the arms 114 along the longitudinal direction L and, in an embodiment, are formed of a sheet of the rigid, durable material.

The frame 100, as shown in FIG. 1, has a plurality of covers 140. Each of the covers 140 is attached to the upper support structure 120 and covers a portion of an interior of the frame 100 in the height direction H. In the shown embodiment, each of the covers 140 is movable about a hinge disposed on the upper support structure 120 to expose or cover the interior of the frame 100. In other embodiments, the covers 140 may be entirely removable from the frame 100 to expose the interior of the frame 100.

The frame 100, as shown in FIG. 1, has a plurality of guard doors 150. Each of the guard doors 150 is attached to the base 110 and covers a portion of the sidewall 130 in the width direction W. The guard doors 150 are removably attached between the base 110 and the upper support structure 120. In the shown embodiment, each of the guard doors 150 is removable by a latch to expose or cover the portion of the sidewall 130.

As shown in FIGS. 1 and 2, the frame 100 has a plurality of drive systems 160 attached to the base 110. Each of the drive systems 160 includes a motor mount 162 attached to the base 110, as shown in FIG. 2, and a drive device 164 disposed on the motor mount 162, as shown in FIG. 1. In an embodiment, the drive device 164 is a motor that drives a belt or chain. In other embodiments, the drive device 164 may be any type of drive element that can drive rotation to the roller assemblies 200 as described below.

In the embodiment shown in FIGS. 1 and 2, the frame 100 includes a plurality of modular sections 170 attachable together along the longitudinal direction L to form the frame 100 of the screening device 10. Each of the modular sections 170 includes a portion of the base 110 extending between adjacent end sections 112 of the base 110, two longitudinal beams 122 and at least one crossbeam 124 of the upper support structure 120, and a pair of sidewalls 130 extending between the adjacent end sections 112. The modular sections 170 have the same components but may have different dimensions from one another along the longitudinal direction L and may be arranged and selected based on the screening application of the screening device 10. The frame 100 has four modular sections 170 attached together in the shown embodiment, but could have less than four or more than four in other embodiments to form a screening device 10 with different dimensions along the longitudinal direction L. The modular sections 170 may be attached together with any type of releasable fastener, such as nuts and bolts.

An exemplary one of the roller assemblies 200 will now be described in detail, but the description applies equally to each of the roller assemblies 200 of the screening device 10. Each of the roller assemblies 200, as shown in FIGS. 3A-3C, has a shaft 210, a plurality of discs 220 disposed on the shaft 210, a plurality of spacing assemblies 250 disposed on the shaft 210 between the discs 220, a pair of bearings 270 disposed on the ends of the shaft 210, and a sprocket assembly 280 disposed at one of the ends of the shaft 210.

Figure 3A:
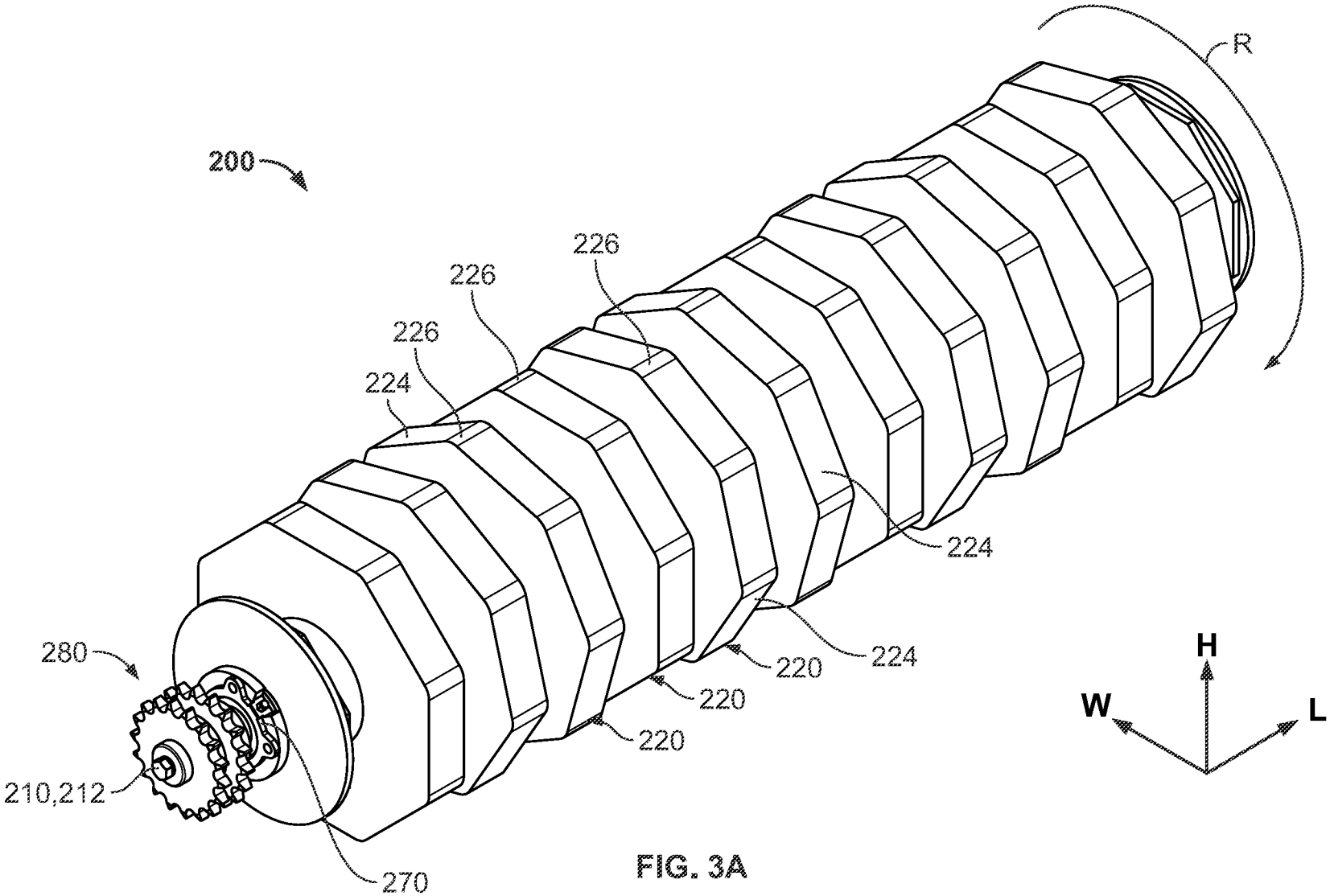
FIG. 3A is a perspective view of a roller assembly of the screening device.
Figure 3B:
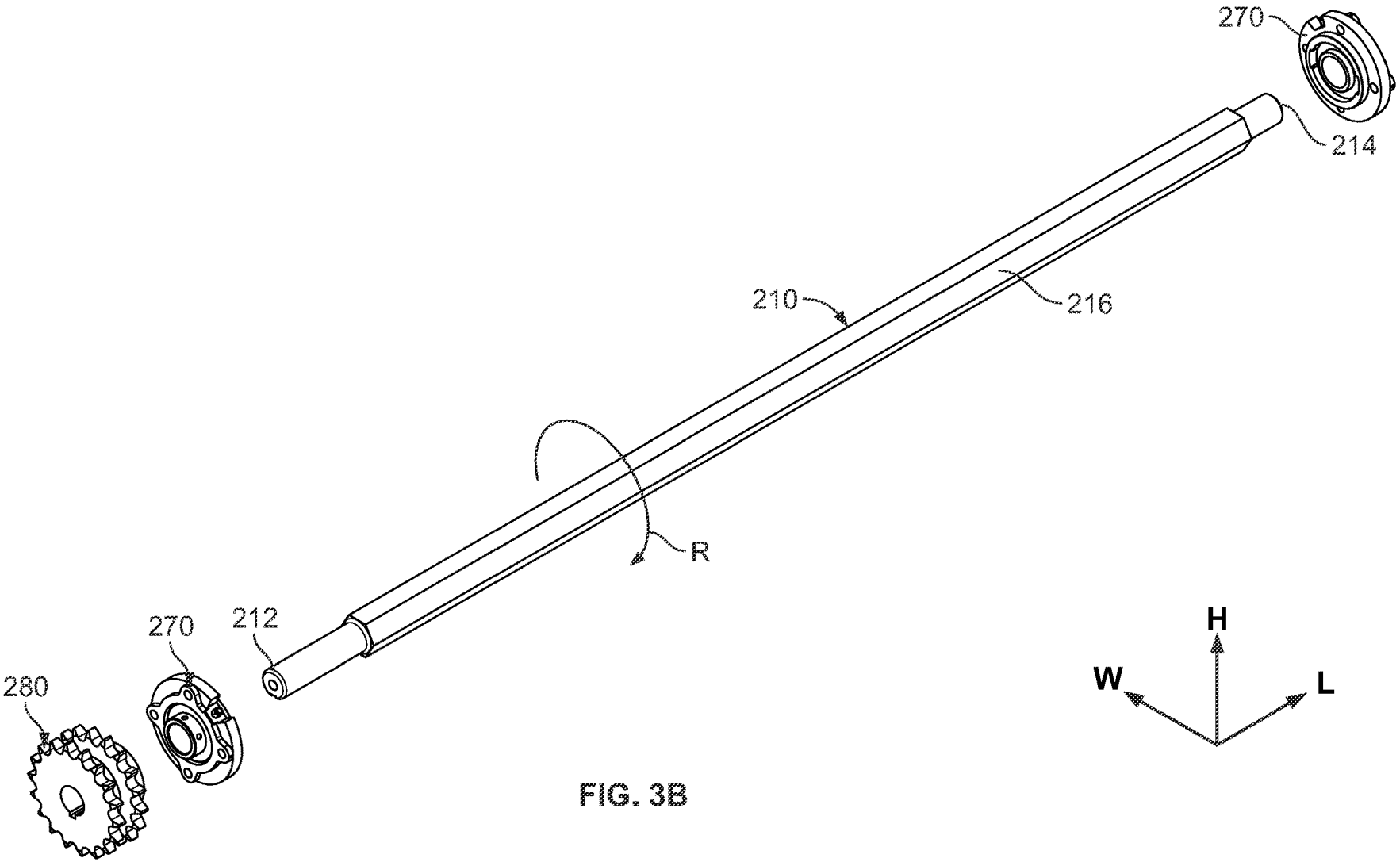
FIG. 3B is an exploded perspective view of a shaft, a pair of bearings, and a sprocket assembly of the roller assembly.

The shaft 210, as shown in FIG. 3B, extends along the width direction W between a first end 212 and an opposite second end 214. The shaft 210 has a polygonal outer shape 216 between the first end 212 and the second end 214. In the shown embodiment, the polygonal outer shape 216 is a hexagonal shape. In other embodiments, the polygonal outer shape 216 may be any other shape having straight sides, such as a square or a pentagon.

Figure 3C:
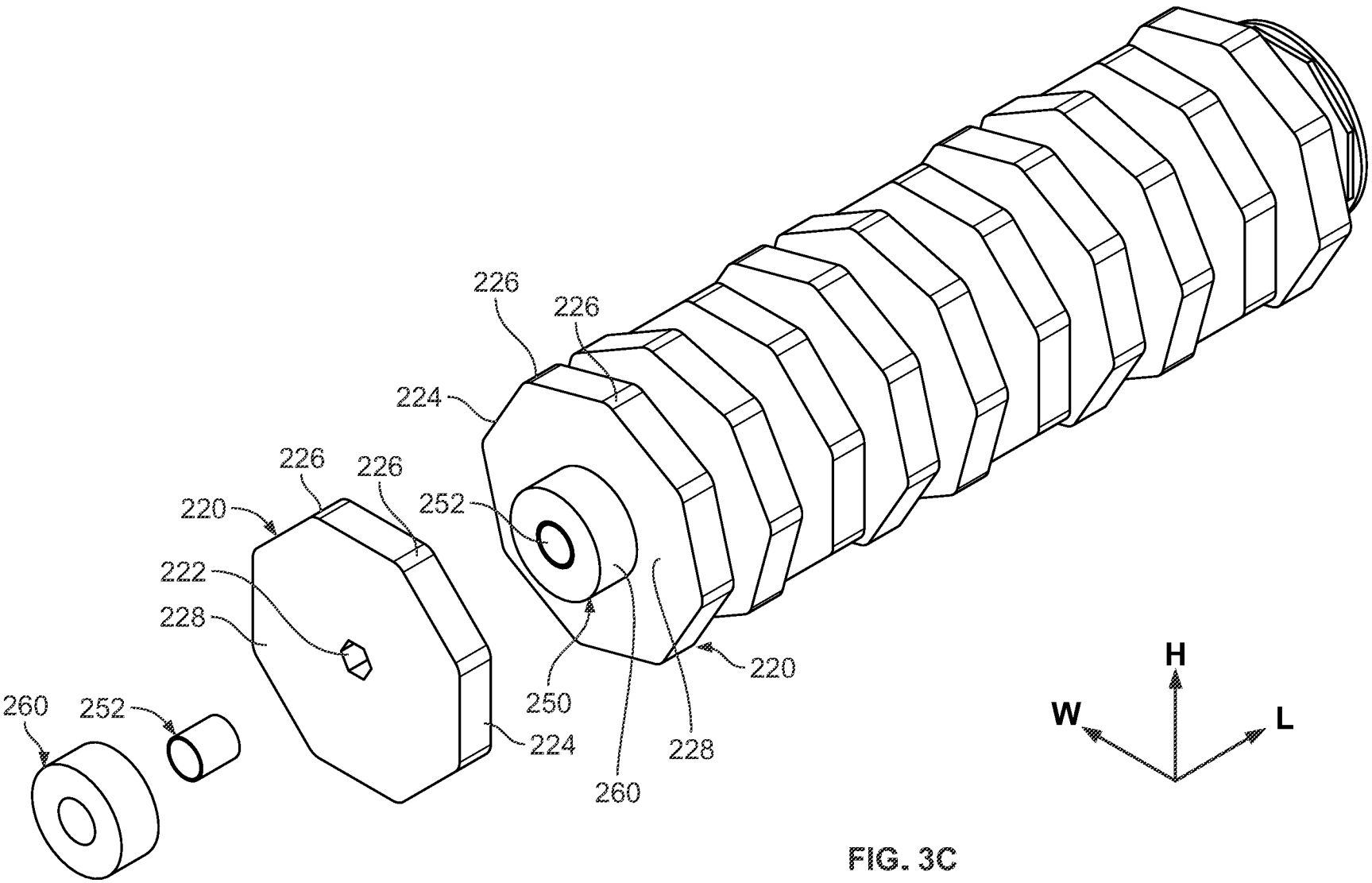
FIG. 3C is a partially exploded perspective view of a plurality of discs and spacing assemblies of the roller assembly.

The discs 220, as shown in FIGS. 3A and 3C, each have a central passageway 222 extending centrally through the disc 220, an outer contact surface 224 extending around a perimeter of the disc 220, and a pair of lateral surfaces 228 opposite one another in the width direction W. The central passageway 222 is an opening having a polygonal shape corresponding to the polygonal outer shape 216 of the shaft 210. The central passageway 222 receives the shaft 210 and rotation of the shaft 210 about a rotational direction R shown in FIGS. 3A and 3B rotates the discs 220.

The outer contact surface 224 has a polygonal shape with a plurality of straight sides that form a plurality of points 226, as shown in FIGS. 3A and 3C. In the shown embodiment, the outer contact surface 224 has an octagonal shape with eight points 226. In other embodiments, the outer contact surface 224 may have any polygonal shape forming at least three points 226. As shown in FIG. 3A, each of the points 226 of one of the discs 220 is offset in the rotational direction R from each of the points 226 of an adjacent one of the discs 220 on the shaft 210.

Each of the spacing assemblies 250 is disposed on the shaft 210 between a pair of adjacent discs 220. The spacing assemblies 250 maintain a spacing of the discs 220 along the shaft 210 during rotation of the roller assembly 200. As shown in FIG. 3C, each spacing assembly 250 includes an inner spacer 252 disposed on the shaft 210 and an outer spacer 260 disposed around the inner spacer 252.

Figure 4A:
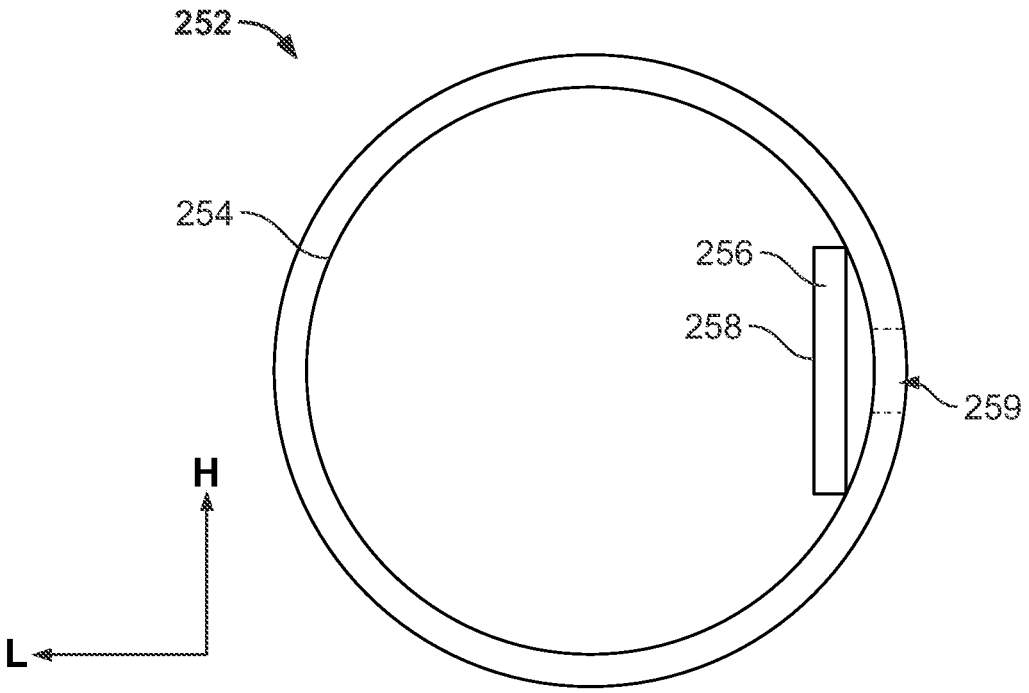
FIG. 4A is a side view of an inner spacer of the spacing assembly.
Figure 4B:
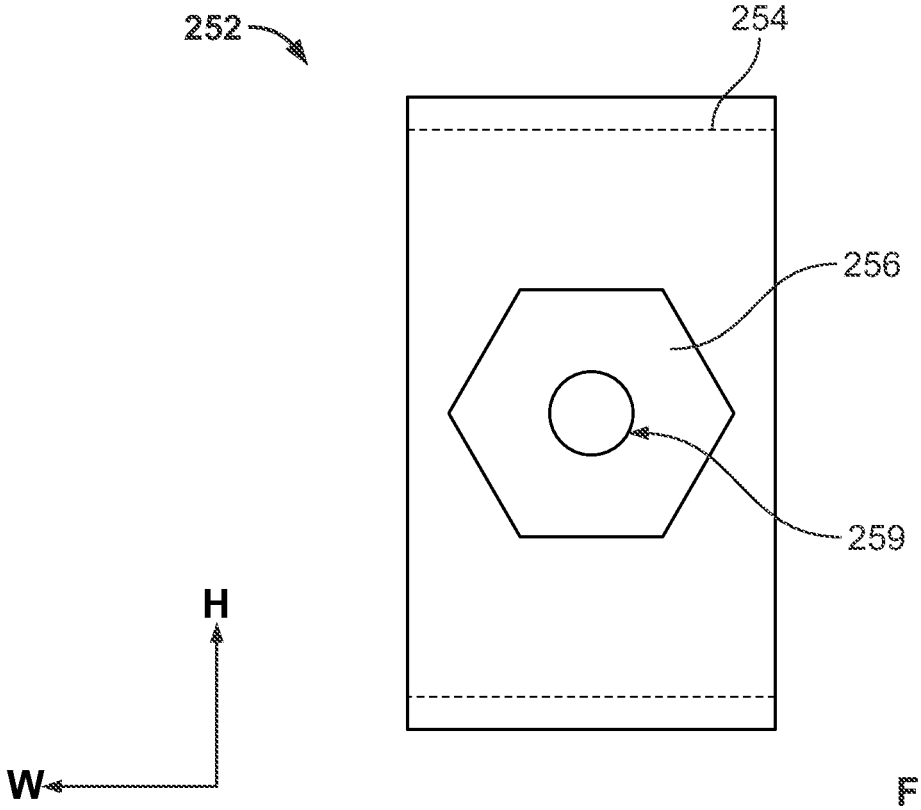
FIG. 4B is another side view of the inner spacer.

The inner spacer 252 is shown in greater detail in FIGS. 4A and 4B. The inner spacer 252 has a cylindrical inner shape 254 and an insert 256 fixed to the inner spacer 252 within the cylindrical inner shape 254. The portion of the inner spacer 252 forming the cylindrical inner shape 254 may be cylindrical tube, such as of a metal material. The insert 256 is a separate piece, for example having a hexagonal shape as shown in FIG. 4B, that is positioned within the cylindrical inner shape 254 and secured to the cylindrical inner shape 254 to provide a straight edge for engagement of the shaft 210. In an embodiment, the insert 256 can be positioned within the cylindrical inner shape 254 and can be welded to the cylindrical inner shape 254 through an access passageway 259 extending through the inner spacer 252, shown in FIGS. 4A and 4B.

When the insert 256 is fixed in the cylindrical inner shape 254 as shown in FIGS. 4A and 4B, the insert 256 forms a planar surface 258 within the cylindrical inner shape 254. While the cylindrical inner shape 254 alone could rotate with respect to the shaft 210 having the polygonal outer shape 216, the polygonal outer shape 216 engages the planar surface 258 formed by the insert 256 to allow the inner spacer 252 to rotate synchronously with the shaft 210. Synchronous rotation of the inner spacer 252 with the shaft 210 prevents the inner spacer 252 from rotating with respect to the discs 220 and wearing into the discs 220, thereby inhibiting movement of the discs 220 along the shaft 210 in the width direction W and limiting wear of the roller assembly 200.

Figure 5:
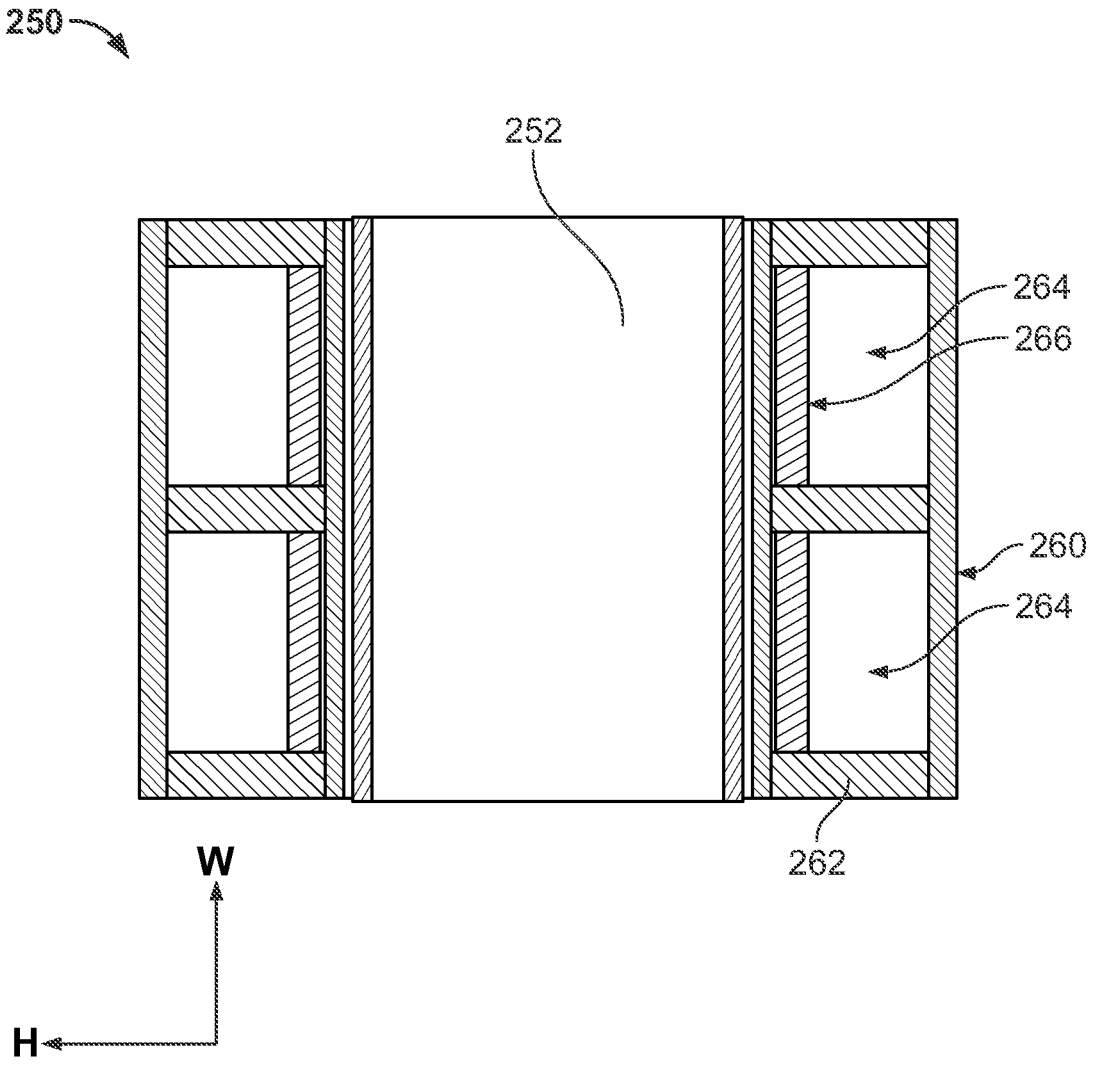
FIG. 5 is a sectional view of the spacing assembly.

The outer spacer 260 is shown positioned around the inner spacer 252 in FIG. 5. The outer spacer 260 has a body 262 defining a plurality of inner receiving spaces 264 separate from one another and a plurality of support elements 266 each received in one of the inner receiving spaces 264. The body 262 extends circumferentially around the inner spacer 252 and each of the inner receiving spaces 264, in an embodiment, extends continuously around the inner spacer 252. The body 262 is formed of an elastically compressible material, such as rubber. Each of the support elements 266 is formed of a rigid material, such as a plastic.

In the shown embodiment, the body 262 defines two inner receiving spaces 264 and has two support elements 266 disposed in the inner receiving spaces 264. In other embodiments, the body 262 may have one or three or more inner receiving spaces 264 and a corresponding number of support elements 266. The dimensions of the body 262, the inner receiving spaces 264, and the support elements 266 are exemplary in FIG. 5 and may be different in other applications, provided that the outer spacer 260 can still serve the function described below.

As shown in FIG. 5, the support elements 266 extend along the width direction W within the inner receiving spaces 264. The elastically compressible material of the body 262 extends between adjacent discs 220 and abuts against the discs 220, as shown in FIG. 3C. During use, the elastically compressible body 262 can deform to maintain the spacing of the discs 220 and absorb shock without forming a rigid surface that would increase wear of the discs 220. The rigid support elements 266 provide structure to the body 262 to maintain the overall shape of the outer spacer 260 and limit compression of the body 262 along the width direction W. The support elements 266 prevent the body 262 from collapsing inward and losing shock absorbing capabilities over time. The outer spacer 260 with the support elements 266 maintains the distance between the discs 220 over time, inhibiting movement of the discs 220 along the shaft 210 in the width direction W and limiting wear of the roller assembly 200.

As shown in FIGS. 3A and 3B, each of the roller assemblies 200 has one of the bearings 270 disposed on each of the first end 212 and the second end 214 of the shaft 210. The shaft 210 is rotatable within the bearings 270. In the shown embodiment, each of the bearings 270 is a pilot flange bearing. In other embodiments, each of the bearings 270 may be a pillow block bearing.

As shown in FIGS. 3A and 3B, each of the roller assemblies 200 has one of the sprocket assemblies 280 disposed on the first end 212 of the shaft 210. Rotation of the sprocket assembly 280 about the rotational direction R imparts rotation to the shaft 210 about the rotational direction R. In the shown embodiment, the sprocket assembly 280 includes a pair of sprockets. In other embodiments, the sprocket assembly 280 may include any number and arrangement of sprockets required to transmit a driving input from the drive device 164 to the shaft 210, as described below.

Figure 6A:
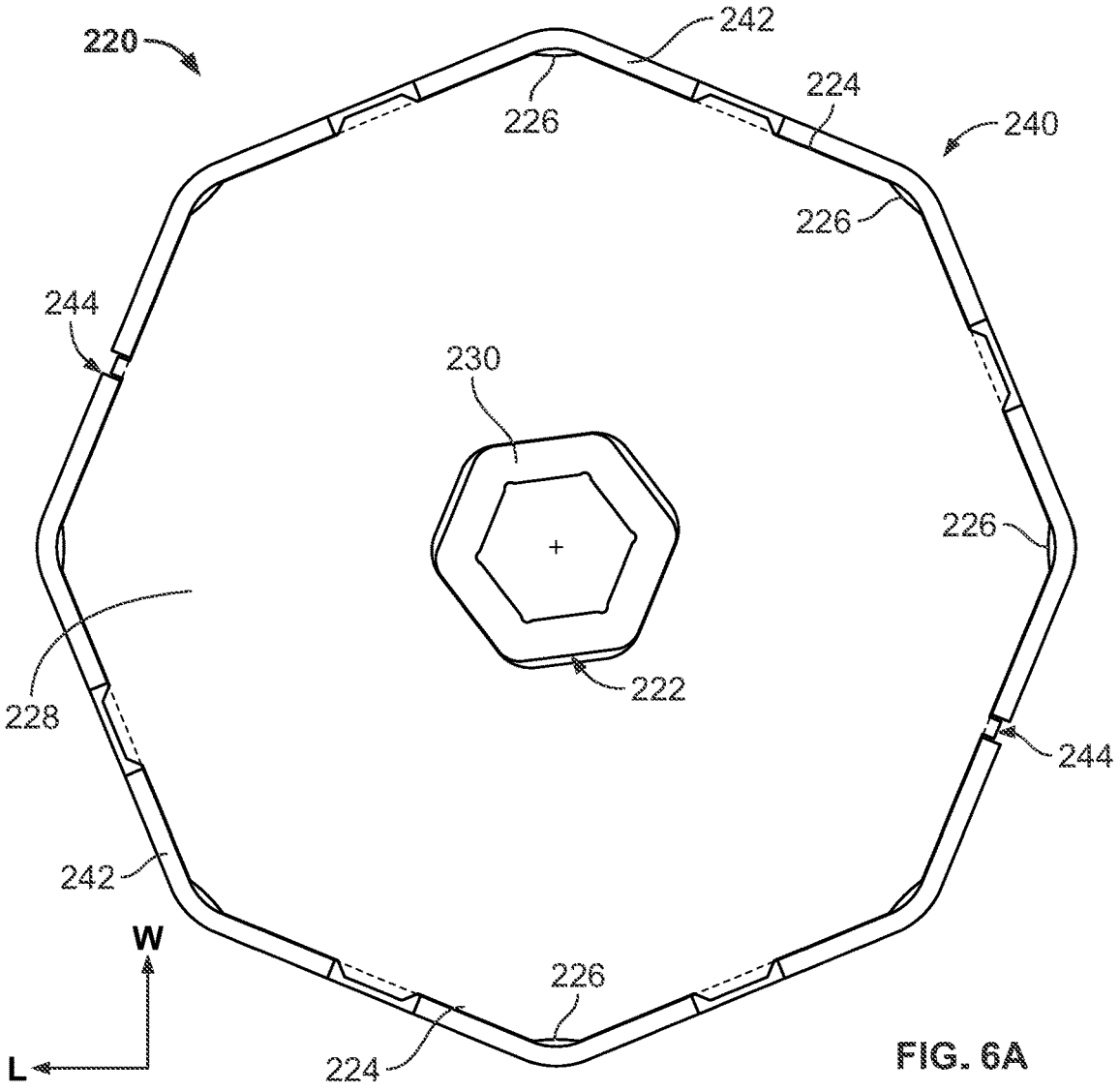
FIG. 6A is a side view of a disc of the roller assembly according to an embodiment.
Figure 6B:
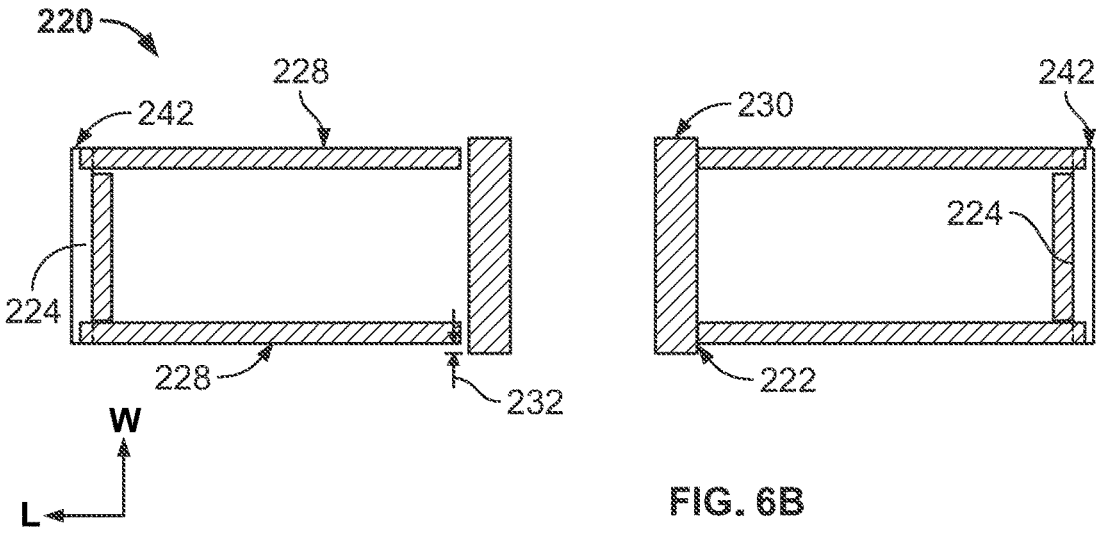
FIG. 6B is a sectional view of the disc of FIG. 6A.

In another embodiment of the discs 220, shown in FIGS. 6A and 6B, the disc 220 has a reinforced layer 230 and an outer wear band 240.

The reinforced layer 230, as shown in FIGS. 6A and 6B, is disposed within the central passageway 222 and receives the shaft 210. In an embodiment, the reinforced layer 230 is clearance fit in the central passageway 222. The reinforced layer 230 has a polygonal shape corresponding to the polygonal outer shape 216 of the shaft 210 and fits around the shaft 210; the reinforced layer 230, the shaft 210, and the central passageway 222 have a same polygonal shape in an embodiment. The reinforced layer 230 may, for example, be cut from a hexagonal tube and broached to fit the central passageway 222 and the polygonal outer shape 216 of the shaft 210. In the embodiment shown in FIG. 6B, the reinforced layer 230 is larger than the disc 220 in the width direction W and extends beyond the lateral surfaces 228 of the disc 220 by a reinforced distance 232. In another embodiment, the reinforced layer 230 may be flush with the lateral surfaces 228 of the disc 220.

The disc 220 is formed of a first material and the reinforced layer 230 is formed of a second material that is more wear resistant than the first material. In an embodiment, the reinforced layer 230 is formed of a steel. The reinforced layer 230 around the shaft 210 prevents the shaft 210 from wearing directly on the first material of the disc 220 in the central passageway 222, providing a more wear and friction-resistant material that prolongs the useful life of the roller assembly 200.

The outer wear band 240 is disposed around the outer contact surface 224 of the disc 220, as shown in FIG. 6A. The outer wear band 240 extends entirely around the outer contact surface 224 in an embodiment. In the embodiment shown in FIG. 6A, the outer wear band 240 is formed of a plurality of band pieces 242 disposed around the outer contact surface 224 and attached to one another at a plurality of weld joints 244.

The outer wear band 240 and the band pieces 242 are formed of the second material that is more wear resistant than the first material of the disc 220. In an embodiment, the outer wear band 240 and the band pieces 242 are formed of a same material as the reinforced layer 230, a steel material, but may alternatively be formed of a different wear resistant material than the reinforced layer 230.

The outer wear band 240 prevents the outer contact surface 224 of the disc 220 from wearing during use, for example when the outer contact surface 224 contacts a material to be sorted. The weld joints 224 are positioned between the points 226 of the outer contact surface 224 as shown in FIG. 6A, and spaced apart from the points 226, to limit direct contact with the weld joints 244 and prolong the attachment of the band pieces 242.

The roller assemblies 200 are assembled with the frame 100 to form the screening device 10 as shown in FIGS. 1 and 2. The roller assemblies 200 are held by the frame 100 and are rotatable with respect to the frame 100. A plurality of roller assemblies 200 are disposed in each of the modular sections 170 of the frame 100.

As shown in FIG. 2, each of the roller assemblies 200 extends along the width direction W between the sidewalls 130. The roller assemblies 200 are secured to and extend through the sidewalls 130. Each of the bearings 270 is positioned on a side of one of the sidewalls 130 opposite the discs 220 and is attached to the one of the sidewalls 130. The sprocket assembly 280 of each of the roller assemblies 200 is positioned outside of the sidewalls 130, as shown in FIG. 2, on a side of one of the sidewalls 130 opposite the discs 220. The sprocket assembly 280 is removably coverable by the guard doors 150, as shown in FIG. 1.

The drive devices 164 positioned on the motor mounts 162 each engage the sprocket assemblies 280 of a plurality of roller assemblies 200 and can drive the roller assemblies 200 to rotate based on a control signal received by the drive device 164. In the shown embodiment, the drive device 164 drives a chain disposed around the plurality of roller assemblies 200 to rotate the roller assemblies 200 and the discs 220. In other embodiments, the drive device 164 can be any type of motive device that can drive the roller assemblies 200 to rotate either directly or via the sprocket assemblies 280.

During use of the screening device 10, the drive systems 160 drive the roller assemblies 200 to rotate. The actuation of the roller assemblies 200 sorts or screens a material disposed on the roller assemblies 200 within the frame 100, passing larger pieces along the screening device 10 in the longitudinal direction L while allowing smaller pieces to fall through the roller assemblies 200. The features of the screening device 10 described above improve the structure of the frame 100 and limit wear of the roller assemblies 200, decreasing costs by prolonging the useful life and limiting maintenance of the screening device 10.

What is claimed is:

1. A roller assembly for a screening device, comprising:
a shaft extending along a width direction;
a pair of discs disposed on the shaft; and
a spacing assembly disposed on the shaft between the pair of discs, the spacing assembly includes an inner spacer disposed around the shaft and an outer spacer disposed around the inner spacer, the outer spacer has a body defining an inner receiving space and a support element disposed in the inner receiving space, the body abuts against the discs and is formed of an elastically compressible material, the support element limits compression of the body along the width direction.

2. The roller assembly of claim 1, wherein the inner receiving space is one of a plurality of separate inner receiving spaces defined by the body, one support element is received in each of the separate inner receiving spaces.

3. The roller assembly of claim 1, wherein the shaft has a polygonal outer shape.

4. The roller assembly of claim 3, wherein the inner spacer has a cylindrical inner shape and an insert fixed to the inner spacer within the cylindrical inner shape, the insert forms a planar surface within the cylindrical inner shape.

5. The roller assembly of claim 4, wherein the polygonal outer shape engages the insert and the inner spacer rotates synchronously with the shaft.

6. The roller assembly of claim 1, wherein each disc of the pair of discs has a central passageway extending through the disc and an outer contact surface having a plurality of points, the central passageway receives the shaft.

7. The roller assembly of claim 6, wherein the disc has a reinforced layer disposed within the central passageway around the shaft, the disc is formed of a first material and the reinforced layer is formed of a second material that is more wear resistant than the first material.

8. The roller assembly of claim 7, wherein the shaft, the central passageway, and the reinforced layer each have a same polygonal shape.

9. The roller assembly of claim 7, wherein each of the plurality of points of one of the pair of discs are offset from each of the plurality of points of the other of the pair of discs in a rotational direction of the shaft.

10. The roller assembly of claim 6, wherein the disc has an outer wear band disposed around the outer contact surface, the disc is formed of a first material and the outer wear band is formed of a second material that is more wear resistant than the first material.

11. The roller assembly of claim 10, wherein the outer wear band is formed of a plurality of band pieces disposed around the outer contact surface and attached to one another at a plurality of weld joints.

12. The roller assembly of claim 11, wherein each of the weld joints is positioned between and spaced apart from each of a pair of adjacent points of the points on the outer contact surface.

13. A screening device, comprising:
a frame; and
a plurality of roller assemblies held by the frame and rotatable with respect to the frame, each of the roller assemblies including a shaft extending along a width direction, a pair of discs disposed on the shaft, and a spacing assembly disposed on the shaft between the pair of discs, the spacing assembly includes an inner spacer disposed around the shaft and an outer spacer disposed around the inner spacer, the outer spacer has a body defining an inner receiving space and a support element disposed in the inner receiving space, the body abuts against the discs and is formed of an elastically compressible material, the support element limits compression of the body along the width direction.

14. The screening device of claim 13, wherein the frame includes a plurality of modular sections attachable together to form the screening device, each of the modular sections has the plurality of roller assemblies.

15. The screening device of claim 13, wherein the frame has a base, an upper support structure connected to the base, and a plurality of sidewalls held between the base and the upper support structure, the roller assemblies are secured to and extend through the sidewalls.

16. The screening device of claim 15, wherein the upper support structure has a plurality of longitudinal beams and a plurality of crossbeams extending perpendicularly to the longitudinal beams, each of the longitudinal beams and the crossbeams is a tube having a polygonal cross-section.

17. The screening device of claim 15, wherein each of the roller assemblies has a pair of bearings disposed at opposite ends of the shaft in the width direction, the shaft is rotatable within the bearings, the bearings are each a pilot flange bearing attached to one of the sidewalls.

18. The screening device of claim 15, wherein each of the roller assemblies has a sprocket assembly connected to the shaft and disposed on a side of the sidewalls opposite the discs.

19. The screening device of claim 18, wherein the frame has a drive system including a drive device disposed on a motor mount attached to the base, the drive device engages the sprocket assembly of each of the roller assemblies and drives the roller assemblies to rotate.

20. The screening device of claim 18, wherein the frame has a plurality of guard doors removably attached between the base and the upper support structure and covering the sprocket assemblies.

* * * * *